United States Patent [19]

Takagi et al.

[11] Patent Number: 4,896,977

[45] Date of Patent: Jan. 30, 1990

[54] THERMAL PRINTER HAVING A STRUCTURE FOR SUPPORTING A PRINT HEAD WITH A DRIVER ON ITS FRONT SURFACE

[75] Inventors: Kazuhiko Takagi; Naohisa Kinoshita, both of Nagoya, Japan

[73] Assignee: Brother Kogyo Kabushiki Kaisha, Nagoya, Japan

[21] Appl. No.: 165,973

[22] Filed: Mar. 9, 1988

[30] Foreign Application Priority Data

Mar. 12, 1987 [JP] Japan ..... 62-36087[U]

[51] Int. Cl.[4] ..... B41J 3/20

[52] U.S. Cl. ..... 400/120; 219/216; 346/76 PH

[58] Field of Search ..... 400/120; 346/76 PH; 219/216 PH, 538, 539, 541, 543, 544

[56] References Cited

U.S. PATENT DOCUMENTS

| | | | |
|---|---|---|---|
| 4,396,308 | 8/1983 | Applegate et al. | 400/120 |
| 4,606,267 | 8/1986 | Wessel et al. | 400/120 |
| 4,626,871 | 12/1986 | Schuessler | 400/120 |
| 4,723,853 | 2/1988 | Suzaki et al. | 400/120 |

FOREIGN PATENT DOCUMENTS

| | | | |
|---|---|---|---|
| 115373 | 7/1982 | Japan | 400/120 |
| 188452 | 10/1984 | Japan | 400/120 |
| 46267 | 3/1985 | Japan | 400/120 |
| 135267 | 7/1985 | Japan | 400/120 |
| 174664 | 9/1985 | Japan | 400/120 |
| 220763 | 11/1985 | Japan | 400/120 |
| 236767 | 11/1985 | Japan | 400/120 |
| 257257 | 12/1985 | Japan | 400/120 |
| 3966 | 1/1987 | Japan | 400/120 |

*Primary Examiner*—David A. Wiecking

*Attorney, Agent, or Firm*—Oliff & Berridge

[57] ABSTRACT

A thermal printer for printing with a print head moved relative to and in contact with a recording medium, supported by a platen. The print head has a plurality of printing elements arranged on its front surface, in a direction intersecting a print line. The print head is supported by a support structure movably between printing and retracted positions. The support structure provides, at least when placed in the printing position, a wedge-shaped clearance between the front surface of the print head, and a plane tangent to the bearing surface of the platen. The wedge-shaped clearance increases with a distance from the printing elements in a direction parallel to the print line. The print head further has a head driver secured on its front surface such that the head driver is positioned within said wedge-shaped clearance. The head driver is electrically connected to the printing elements, for controlling energization of the printing elements.

7 Claims, 4 Drawing Sheets

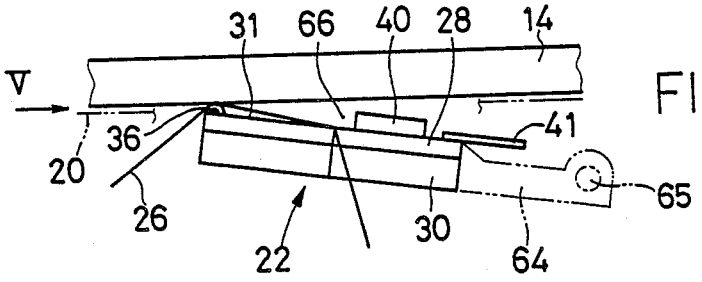
FIG.2
FIG.3
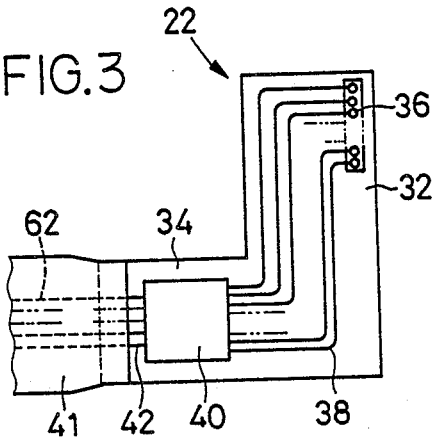
FIG.5
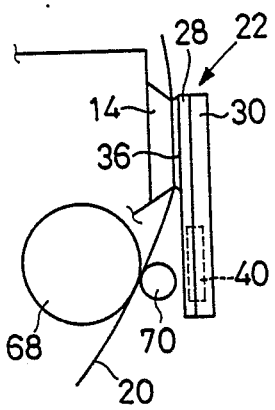
FIG.4
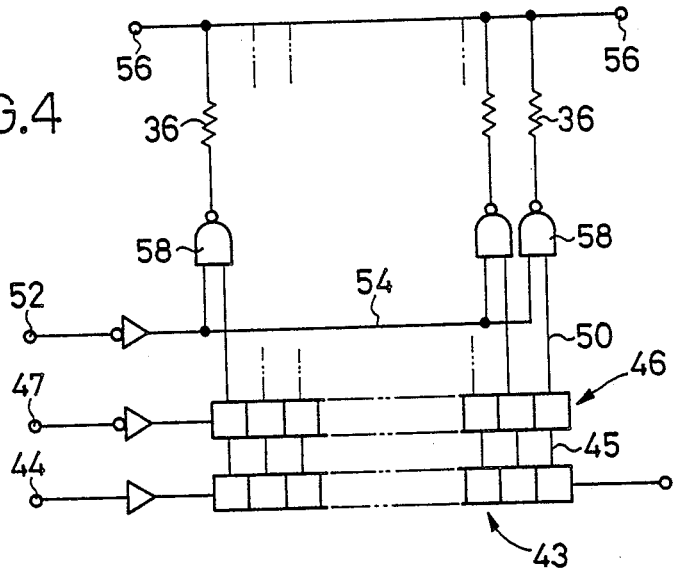

THERMAL PRINTER HAVING A STRUCTURE FOR SUPPORTING A PRINT HEAD WITH A DRIVER ON ITS FRONT SURFACE

BACKGROUND OF THE INVENTION

1. Field of the Invention

The present invention relates to a thermal printing apparatus wherein a printing operation is effected by a print head which is movable along a print line relative to a recording medium while the print head is held in contact with the medium.

2. Discussion of the Prior Art

There is known a thermal printer of a type which includes a platen, a print head, printing elements and a generally thin flat electric cable. The platen bears a force which is imparted from the print head to the recording medium during a printing operation. The print head has a flat front surface facing the recording medium. The printing elements are arranged on the front surface of the head, and are electrically connected to conductors of the electric cable through a printed wiring formed on the front surface of the print head.

In the thermal printer of the type indicated above, the quality of images printed on the recording medium is enhanced as the number of the printing elements increases. However, the number of conductor strips of the printed wiring on the print head surface, and the number of conductor wires of the electric cable increase with the number of the printing elements provided on the print head. Accordingly, the width of the electric cable and the required space for laying the cable through the printer increase, and the connection of the cable becomes difficult. Further, the increase in the number of the printing elements and the consequent dimensional increase of the cable result in an increase in the required capacity of a drive source for reciprocating the print head. As a solution to these inconveniences or drawbacks, it is proposed to use a head driver which is secured on the front surface of the print head and which is connected on its input side to the electric cable and on its output side to the printed wiring connected to the printing elements. The head driver receives serial printing data, and controls the energization of the individual printing elements according to the received printing data. The use of the head driver reduces the number of the conductor wires of the cable, as compared with the number of the printing elements, and therefore permits the cable to have a comparatively small width, while the number of the printing elements is relatively large.

Since the head driver is connected to the printed wiring formed on the front surface of the print head, it is required that the head driver be mounted at the same level as the surface on which the printing elements are disposed. Consequently, the head driver projects from the front surface of the print head, by a distance equal to the thickness of the head driver. Since the thickness is relatively large, the head driver tends to easily interfere with the recording medium, feeding device for the medium, and other components adjacent to the platen. An example of a known arrangement is shown in FIG. 9, in which a paper feed roll 82 and presser roll 84 are located close to a platen 80, in order to minimize a distance A at the trailing end of a paper sheet 86 where a printing operation is impossible. In this arrangement, however, the head driver 88 interferes with the presser roll 84. Therefore, the feed roll 82 and the presser roll 84 should be located a further distance away from the platen 80, as shown in FIG. 10, in order to avoid the interference between the head driver 88 and the presser roll 84. In this case, the distance A is undesirably increased.

To minimize the distance A where the printing is impossible, another solution as indicated in FIGS. 11 and 12 is proposed. According to this solution, the feed and presser rolls 82, 84 are located relatively close to the platen 80 as shown in FIG. 9, but the head driver 88 is attached to a lower end of a vertically extending elongate front surface 94 of a print head 92, so that the rolls 82, 84 are located above the head driver 88. This arrangement suffers from increased costs of material and manufacture of the print head 92 due to an increased length of the surface 94. Further, the arrangement results in an increased load applied to the drive source for moving the print head 92 (carriage), and increased size and weight of the printer.

SUMMARY OF THE INVENTION

It is accordingly an object of the present invention to provide a thermal printer wherein a print head has a head driver attached to its front surface, and which is excellent in print quality, relatively compact in construction and economical to manufacture, and which is free from an interference of the head driver with components adjacent to a platen.

The above object can be achieved according to the principle of the present invention, which provides a thermal printer wherein a printing operation is effected by a print head which is movable along a print line relative to a recording medium while the print head and the recording medium are held in contact with each other, comprising: (a) a platen having a bearing surface for supporting the recording medium; (b) a plurality of printing elements which are arranged in a direction intersecting the print line, on a front surface of the print head which faces the recording medium supported by the platen; (c) head supporting means for supporting the print head movably between a printing position in which the printing elements contact the recording medium on the platen, and a retracted position in which the printing elements are spaced away from the recording medium, the head supporting means providing, at least in the printing position thereof, a wedge-shaped clearance between the front surface of the print head, and a plane tangent to the bearing surface of the platen, the wedge-shaped clearance increasing with a distance from the printing elements in a direction parallel to the print line; and (d) a head driver secured to the front surface of the print head such that the head driver is positioned within the wedge-shaped clearance, the head driver being electrically connected to the plurality of printing elements, for controlling energization of the printing elements.

In the thermal printer of the present invention constructed as described above, the printing elements contact the recording medium such that the wedge-shaped clearance is provided between the front surface of the print head and the bearing surface of the platen, so that the head driver secured on the front surface of the head is positioned within the wedge-shaped clearance. In this arrangement, the head driver does not interfere with the recording medium, or is spaced away from the feeding device, although the head driver protrudes from the front surface of the print head. Hence, the feed roll, presser roll and other components of the feeding device may be located extremely close to the platen. Thus, the present arrangement makes it possible to reduce the distance of the trailing end portion of the recording medium where a printing is impossible. Namely, the present invention permits a printing operation close to the trailing edge of the recording medium, while using the head driver which allows for a reduced width of the electric cable.

Further, the instant arrangement eliminates the need of positioning the head driver well below the feeding device in order to avoid an interference therebetween. That is, the present invention eliminates the need of providing the print head with a relatively long vertically extending front surface so that the head driver is disposed in its lower end portion. Accordingly, the overall size and weight of the printer can be reduced, and the material and manufacturing costs of the printer can be lowered.

In one form of the present invention, the head supporting means supports the print head pivotally between the printing and retracted positions, about an axis which is perpendicular to the print line.

In another form of the invention, the the head supporting means supports the print head pivotally between the printing and retracted positions, about an axis which is parallel to the print line.

In a further form of the invention, the front surface of the print head is a generally L-shaped surface including an upright portion having a length perpendicular to the print line, and a horizontal portion which extends horizontally from one of opposite ends of the upright portion. In this case, the printing elements and the head driver are disposed on the upright portion and the horizontal portion, respectively. This arrangement is advantageous when the print head is adapted to effect a printing operation via a thermal print ribbon which is passed between the printing elements and the recording medium. More specifically, the height or vertical length of the upright portion of the front surface of the print head is determined to be larger than the width of the thermal print ribbon, and the print ribbon is passed between the upright portion and the recording medium, along a path above the horizontal portion, i.e., above the head driver, in order to avoid an interference between the head driver and the thermal print ribbon.

Where an ordinary thermal print ribbon is used, the printing elements are heat-generating elements which generate heat responsive to an electric current applied thereto by the head driver. Another type of thermal print ribbon is known. This print ribbon includes an ink layer and an electrically resistive layer. In this case, the printing elements consist of printing electrodes which contact the electrically resistive layer of the print ribbon. The printing electrodes are energized by the head driver, to apply an electric current to corresponding local areas of the electrically resistive layer, and fuse corresponding areas of the ink layer.

The present invention is also applicable to the thermal printer which uses a heat-sensitive recording medium, without using a thermal print ribbon. In this case, the front surface of the print head may be a generally rectangular surface, and the printing elements are disposed at one of opposite ends of the generally rectangular front surface while the head driver is disposed adjacent to the other end of the front surface.

The front surface of the print head may have a printed wiring formed thereon for electrical connection of the printing elements and the head driver. A flexible cable may be fixed at one end thereof to an end of the print head which is opposite to an end of the front surface on which the printing elements are secured. The front surface of the print head may have a printed wiring formed thereon for electrical connection of the head driver and the flexible cable.

BRIEF DESCRIPTION OF THE DRAWINGS

The above and other objects, features and advantages of the present invention will become more apparent by reading the following detailed description of presently preferred embodiments of the invention, when considered in connection with the accompanying drawings, in which:

FIG. 2 is a plan view of a thermal print head of the printer of FIG. 1 when placed in its printing position;

FIG. 3 is a front elevational view of the print head;

FIG. 4 is a diagram showing a circuit equivalent to a head driver for the print head;

FIG. 5 is an elevational view taken in a direction indicated by arrow V in FIG. 2;

DETAILED DESCRIPTION OF THE PREFERRED EMBODIMENTS

Figure 1:
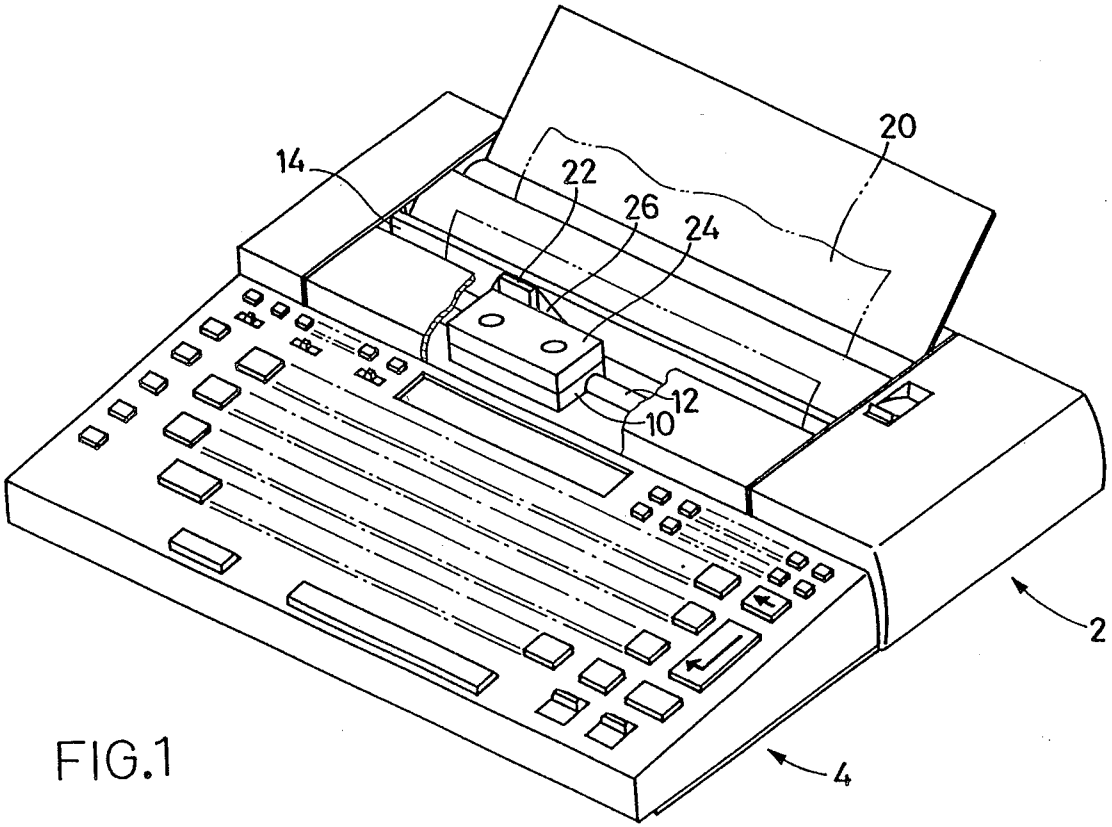
FIG. 1 is a perspective view of an electronic typewriter incorporating one embodiment of a thermal printer of the present invention.

Referring first to FIG. 1, the electronic typewriter includes the thermal printer generally indicated at 2, and a keyboard 4 connected to the thermal printer 2 such that the two components 2, 4 constitute a unitary set. The thermal printer 2 is adapted to effect a printing operation according to printing data entered through the keyboard 4. The printer 2 has a carriage 10 which is slidably supported by a guide bar 12, so that the carriage 10 is moved along a print line, i.e., in an X-axis direction parallel to an elongate planar platen 14 having a flat bearing surface. The platen 14 is provided to support a recording medium in the form of a sheet of paper 20. This paper sheet 20 is fed in a Y-axis direction perpendicular to the X-axis direction, by a feed roll 68 and a presser roll 70 which are shown in FIG. 5.

The carriage 10 carries a thermal print head 22 mounted thereon. The paper sheet 20 is fed between this print head 22 and the platen 14. The carriage 10 also carries a ribbon cassette 24 removably mounted thereon. The ribbon cassette 24 accommodates a thermal print ribbon 26. An active portion of the print ribbon 26 is exposed outside the cassette 24, and extends between the print head 22 and the paper sheet 20.

Referring to FIGS. 2 and 3, the thermal print head 22 includes a substrate 28 and a heat radiator plate 30 which are superposed on each other. The substrate 28 has a flat front surface 31 which faces the paper sheet 20. This front surface 31 has a generally L-shaped configuration consisting of an upright portion 32 and a horizontal portion 34 which lie in the same plane. The upright portion 32 has a length or vertical dimension perpendicular to the print line or platen 14, and the horizontal portion 34 extends horizontally from the lower end of the upright portion 32. The length of the upright portion 32 is determined to be greater than the width of the thermal print ribbon 26, so that the exposed active portion of the print ribbon 26 extends horizontally between the upright portion 32 and the paper sheet 20. The substrate 28 has a plurality of printing elements in the form of heat-generating elements 36 which are formed on the upright portion 32 of the front surface 31. The heat-generating elements 36 are arranged in a row along one vertical edge of the upright portion 32. For example, the row consists of 32 heat-generating elements 36 which correspond to 32 dots forming a vertical column of a dot matrix. The heat-generating elements 36 are electrically connected to respective conductor strips 38 of a printed wiring formed on the front surface 31 of the substrate 28. Namely, the conductor strips 38 extend from the heat-generating elements 36 to the horizontal portion 34 of the front surface 28, as shown in FIG. 3. Like the substrate 28, the heat radiator plate 30 is also generally L-shaped. The substrate 28 is secured to the radiator plate 30.

The horizontal portion 34 of the flat front surface 31 of the substrate 28 of the print head 22 has an IC head driver 40 secured thereon. The output side of the head driver 40 is connected to the ends of the printed conductor strips 38 remote from the heat-generating elements 36, while the input side of the head driver 40 is connected to several relatively short conductor strips 42 printed in a terminal part of the horizontal portion 34, which terminal part is provided at one of opposite ends of the horizontal portion 34 remote from the upright portion 32. The short conductor strips 42 are connected to a flexible cable 41 for controlling the heat-generating elements 36 via the head driver 40.

Referring to FIG. 4, there is illustrated a circuit equivalent to an example of the head driver 40. The illustrated example includes a shift register 43 which has memory locations corresponding to the heat-generating elements 36. That is, the memory locations correspond to the dots (e.g., 32 dots) of each vertical column which constitutes a part of a dot matrix for each character. The shift register 43 receives from a DATA terminal 44 serial printing data for successive vertical columns of the dot matrix. The memory locations of the shift register 43 are connected to respective memory locations of a latch 46 through lines 45. The printing data are transferred from the memory locations of the shift register 43 to the respective memory locations of the latch 46 and temporarily stores therein, when the latch 46 receives a latch pulse from a LATCH terminal 47. Each memory location of the latch 46 is connected through an output line 50 to an input of a NAND gate 58, which has another input connected through an input line 54 to a STROBE terminal 52. An output of each NAND gate 58 is connected to the corresponding heat-generating element 36, which is connected to a power source 56. When the inputs of the NAND gate 58 received from the LATCH and STROBE terminals 47, 52 are both in a high-level state, the output of the NAND gate 58 is in a low-level state, whereby there arises a potential between the output of the NAND gate 58 and the power source 56. As a result, a current flows through the corresponding heat-generating element 36 for a time span determined by the signal from the STROBE terminal 52. Thus, the heat-generating elements 36 are energized. The above sequence of operation applies to each of the columns of a dot matrix which are represented by the serial printing data successively transferred via the DATA terminal 44. In this manner, the energization and deenergization of the heat-generating elements 36 are controlled by means of the head drivr 40.

Referring back to FIG. 3, the short printed conductor strips 42 connected at their one end of the input side of the head driver 40 are connected at their other end to respective conductor wires 62 of the flexible cable 41. Since the number of the signal lines or terminals connected to the head driver 40 is relatively small, the number of the conductor wires 62 connected to the head driver 40 is accordingly reduced, as compared to the number of the heat-generating elements 36. This makes it possible to reduce the width of the flexible cable 41.

The thermal print head 22 having the heat-generating elements 36 and head driver 40 described above is mounted on, or integrally formed as a free end portion of a head support lever 64. This lever 64 functions as head supporting means for supporting the print head 22 between its printing or operative position in which the heat-generating elements 36 are held in pressed contact with the paper sheet 20 via the print ribbon 26, and its retracted or inoperative position in which the elements 36 are spaced away from the sheet 20. Described more specifically, the head support lever 64 is pivotally supported at its fixed end by a vertical shaft 65 which vertically extends from the carriage 10 perpendicularly to the platen 14 or print line. In this arrangement, the support lever 64 is pivotable about the shaft 65 in a horizontal plane, between two positions corresponding to the printing and retracted positions of the print head 22.

The fixed or pivot end of the support lever 65 is located upstream of the free end, as viewed in the printing direction (rightward direction as seen in FIG. 2). The shaft 65 is positioned relative to the platen 14 so that there exists a wedge-shaped clearance 66 between the flat L-shaped front surface 31 of the print head 22 (more precisely, substrate 28) and the platen 14 (paper sheet 20), when the print head 22 is placed in its printing position of FIG. 2. This wedge-shaped clearance 66 increases with a distance from the point of contact of the heat-generating elements 36 with the platen 14, in the printing direction. in other words, a larger clearance is provided on the side of the horizontal portion 34 of the front surface 31, than on the side of the upright portion 32, so that the head driver 40 secured on the horizontal portion 34 is positioned within the wedge-shaped clearance 66. Therefore, even when the print head 22 is placed in its printing position, the head driver 40 is spaced away from a vertical plane which includes the flat bearing surface of the platen 14.

Thus, the head driver 40 mounted on the print head 22 pivotally supported by the support lever 64 will not interfere with the presser roll 70, as indicated in FIG. 5. Therefore, the feed roller 68 and the presser roll 70 can be located so as to permit a printing close to the trailing edge of the paper sheet 20.

Further, the print ribbon 26 will not contact the head driver 40 provided on the lower horizontal portion 34 of the L-shaped substrate 28, since the print ribbon 26 extends across the length or height of the upper upright portion 32 of the substrate 28. Thus, the print ribbon 26 can be fed smoothly, without a sliding contact with the head driver 40.

Figure 6:
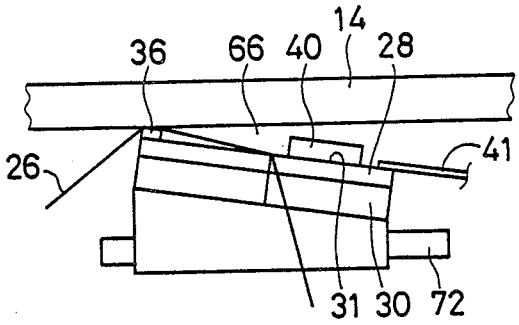
FIGS. 6 and 7 are views corresponding to those of FIGS. 2 and 5, respectively, showing a modified embodiment of the invention.
Figure 7:
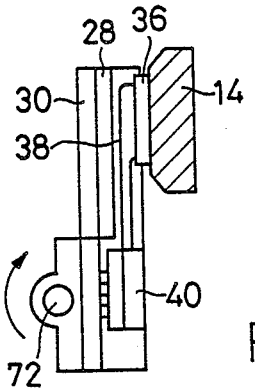

While the print head 22 of the illustrated embodiment is supported by the lever 64 pivotally about the vertical shaft 65, the print head 22 may be supported pivotally about a horizontal shaft 72 as illustrated in FIGS. 6 and 7. More specifically, the print head may be supported by a structure (not shown) pivotally about the axis of the horizontal shaft 72. In this case, too, the front surface 31 of the print head 22 (substrate 28) and the platen 14 cooperate with each other to define the wedge-shaped clearance 66, so that the head driver 40 is positioned within the clearance 66, even when the print head 22 is placed in its printed position.

Figure 8:
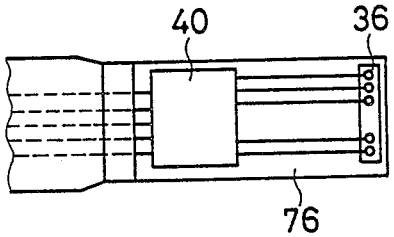
FIG. 8 is a view corresponding to that of FIG. 3, showing a further embodiment of the invention.
Figure 9:
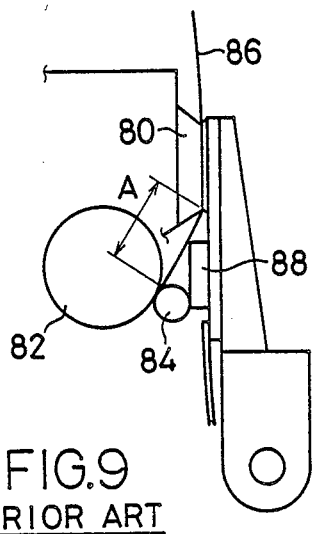
FIG.9 PRIOR ART
FIGS. 9 and 10 are schematic elevational views illustrating known arrangements of a print head, a platen and other components located adjacent to the print head.
Figure 10:
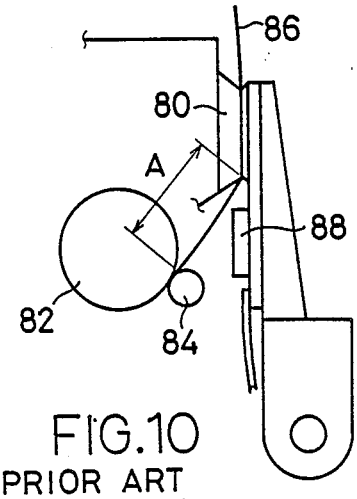
FIG.10 PRIOR ART
Figure 11:
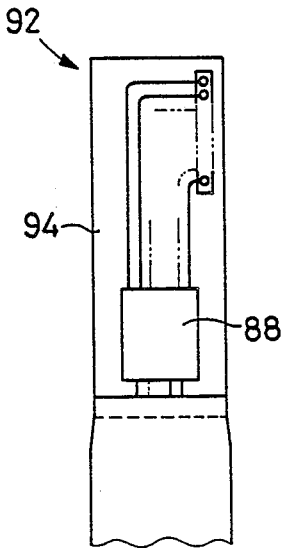
FIG.11 PRIOR ART
FIG. 11 is a front elevational view of another known arrangement of a print head.
Figure 12:
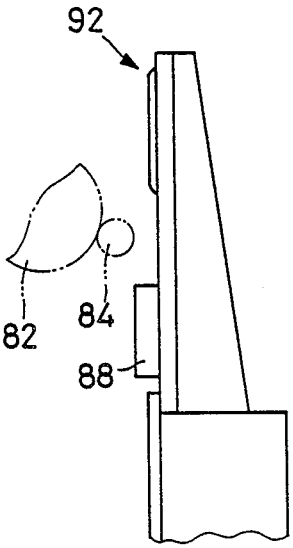
FIG.12 PRIOR ART
FIG. 12 is a side elevational view of the print head of FIG. 11.

In the illustrated embodiment, the substrate 28 and the heat radiator plate 30 of the print head 22 are generally L-shaped, in order to avoid an interference between the head driver 40 and the print ribbon 26. However, if the thermal printer is adapted to effect a printing operation on a heat-sensitive recording medium, without using a thermal print ribbon, the substrate and the radiator plate may take a generally rectangular shape as indicated at 76 in FIG. 8, provided the head driver 40 is spaced away from the platen 14 when the print head 22 is placed in its printing position.

While the illustrated embodiment uses the elongate planar platen 14 having a flat bearing surface, it is possible to use a platen which has a cylindrical, arcuate or otherwise shaped bearing surface.

While the present invention has been described in conjunction with specific embodiments, it is evident that many alternatives, modifications and variations will be apparent to those skilled in the art in light of the foregoing description. Accordingly, it is intended to embrace all such alternatives, modifications and variations that fall within the spirit and scope of the appended claims.

What is claimed is:

1. A thermal printer wherein a printing operation is effected by a print head which is movable along a print line relative to a recording medium while the print head and the recording medium are held in contact with each other via a thermal print ribbon, comprising:

a platen having a bearing surface for supporting said recording medium, said bearing surface extending in a direction parallel to said print line;

said print head having a flat front surface which faces said recording medium supported by said platen, said flat front surface being a generally L-shaped surface including an upright portion having a length perpendicular to said print line, and a horizontal portion which extends horizontally from one of opposite ends of said upright portion, said length of said upright portion being greater than a width of said thermal print ribbon;

a plurality of printing elements which are arranged on said upright portion of said flat front surface of the print head, in a direction intersecting said print line;

head supporting means for supporting said print head movably between a printing position in which said printing elements contact said recording medium on said platen, and a retracted position in which said printing elements are spaced away from the recording medium, said head supporting means providing, at least in said printing position thereof, a wedgeshaped clearance between said flat front surface of said print head, and a plane tangent to said bearing surface of said platen, said wedge-shaped clearance increasing with a distance from said printing elements in said direction parallel to said print line; and a head driver secured to said horizontal portion of said flat front surface of said print head such that said head driver is spaced from said printing elements in said direction parallel to said print line and thereby positioned within said wedge-shaped clearance, said head driver being electrically connected to said plurality of printing elements, for controlling energization of said printing elements.

2. A thermal printer according to claim 1, wherein said head supporting means supports said print head pivotally between said printing and retracted positions, about an axis which is perpendicular to said print line.

3. A thermal printer according to claim 1, wherein said head supporting means supports said print head pivotally between said printing and retracted positions, about an axis which is parallel to said print line.

4. A thermal printer according to claim 1, wherein each of said printing elements consists of a heat-generating element which generates heat responsive to an electric current applied thereto by said head driver.

5. A thermal printer according to claim 1, wherein said printing elements consist of printing electrodes which contact said recording medium via a thermal print ribbon which includes an ink layer and an electrically resistive layer, said printing electrodes being energized by said head driver, to apply an electric current to corresponding local areas of said electrically resistive layer.

6. A thermal printer according to claim 1, wherein said flat front surface of said print head has a printed wiring formed thereon for electrical connection of said printing elements and said head driver.

7. A thermal printer according to claim 1, further comprising a flexible cable which has a fixed end positioned at an end of said print head opposite to an end of said flat front surface on which said printing elements are secured, said flat front surface of the print head has a printed wiring formed thereon for electrical connection of said head driver and said flexible cable.

* * * * *